US005382192A

United States Patent [19]

Hoffman

[11] Patent Number: 5,382,192

[45] Date of Patent: Jan. 17, 1995

[54] DAMPER CONTROL APPARATUS

[75] Inventor: Jeffrey H. Hoffman, Two Rivers, Wis.

[73] Assignee: Classic Modular Systems, Inc., Two Rivers, Wis.

[21] Appl. No.: 86,687

[22] Filed: Jul. 2, 1993

[51] Int. Cl.[6] ..... B08B 15/02

[52] U.S. Cl. ..... 454/61

[58] Field of Search ..... 454/56, 57, 58, 59, 454/61

[56] References Cited

U.S. PATENT DOCUMENTS

| | | | |
|---|---|---|---|
| 2,715,359 | 8/1955 | Mackintosh et al. | 454/61 |
| 4,155,289 | 5/1979 | Garriss | 454/61 |
| 4,377,969 | 3/1983 | Nelson | 454/59 |
| 5,216,782 | 6/1993 | Schenck et al. | 16/194 |

FOREIGN PATENT DOCUMENTS

| | | | |
|---|---|---|---|
| 670207 | 5/1989 | Switzerland | 454/61 |

*Primary Examiner*—Harold Joyce
*Attorney, Agent, or Firm*—Godfrey & Kahn

[57] ABSTRACT

A damper control apparatus for a fume hood which has a moveable sash, and wherein the damper control apparatus includes an axle assembly borne by the fume hood, a cable assembly borne by the sash and disposed in force transmitting relation relative to the axle assembly, and a damper borne by the fume hood and disposed in force receiving relation relative to the axle assembly and moveable along a path of travel into assorted operational positions which correlate with the position of the sash thereby regulating the amount of air withdrawn from the fume hood.

17 Claims, 3 Drawing Sheets

DAMPER CONTROL APPARATUS

BACKGROUND OF THE INVENTION

1. Field of the Invention

The present invention relates generally to a damper control apparatus, and more specifically, to a damper control apparatus for a fume hood which is operable to synchronize the movement of the fume hood sash, and the damper, thereby ensuring that an appropriate amount of air is withdrawn from the fume hood.

2. Background of the Invention

Fume hoods have long been used in research laboratories and the like to protect laboratory personnel from assorted chemical and biological hazards which are attendant with the research environment. Although many different fume hood designs exist, a fume hood, generally speaking, includes a table-like structure having a flat working surface and which positioned within a rectangular-shaped enclosure. This rectangular enclosure is defined by a roof member; left and right side walls, a front wall; and an opposite back wall. The front wall of the enclosure is defined, in part, by an aperture, and a fume hood sash is movably borne by the enclosure and is operable for substantially vertical motion into occluding relation relative to the aperture. This fume hood sash is often manufactured of a thick, relatively heavy gauge transparent panel which may be located in a closed position, or alternatively, may be selectively located to occlude the aperture thereby providing any desired amount of access to the working environment provided by the fume hood.

Fume hoods perform a number of laudatory functions, however, their most important features are to provide a safe working environment for laboratory personnel and to protect others from the harmful effects of chemical splashes and spills or exposure to potentially pathogenic biological agents, and further to evacuate noxious vapors and gases or other malodorous agents from the immediate fume hood environment. In this regard, fume hoods have included several different means for selectively positioning the sash in various locations thus varying the size of the access opening or aperture to meet the demands of the research environment. For example, previous laboratory fume hoods have incorporated various weighted counterbalance assemblies to provide a means for controlling or otherwise maintaining the size of the access opening. Furthermore, several prior art fume hood assemblies have included drive assemblies for closing or opening the sash of the fume hood upon the demand of the operator.

While the prior art fume hood designs have operated with varying degrees of success, they have had numerous shortcomings which have detracted from their usefulness. For example, one of the most noteworthy shortcomings of the prior art assemblies has been the means employed to evacuate or withdraw fumes from the fume hood environment. In this regard, it should be understood that due to the wide variety of research activities which may be undertaken in a fume hood, manufacturers have produced fume hoods having relatively constant air flow rates. Thus, the air flow rate which is selected is normally the rate which is suitable when the fume hood sash is in the fully open position. As one might expect, the amount of electrical power required to drive an associated blower assembly which achieves this required air flow rate can be substantial if many fume hoods are operating substantially simultaneously.

Another shortcoming attendant with the prior art fume hood designs result from characteristics inherent in their individual construction inasmuch as the prior art fume hoods frequently have been manufactured in a fashion where air withdrawn from the fume hood environment must be made up or otherwise delivered back to the laboratory. Consequently, it may be occasionally uncomfortable to work in the vicinity of fume hoods having this design.

Still another deficiency common with respect to the prior art fume hoods is their inability to provide emergency exhaust capability in the event of experimental mishap or accident, such as might be the case in the event of explosion or fire.

Therefore, it has long been known that it would be desirable to have an improved fume hood which addresses many of the deficiencies attendant with the prior art devices and practices and which further provides a convenient and cost effective means for providing a safe research environment.

SUMMARY OF THE INVENTION

Therefore, it is an object of the present invention to provide an improved damper control apparatus.

Another object of the present invention is to provide a damper control apparatus which has particular utility when operatively mounted on a fume hood which includes a moveable sash, and wherein the damper is adapted to move along a path of travel into assorted operational positions which correlate with the position of the sash thereby regulating the amount of air which is withdrawn from the fume hood.

Another object of the present invention is to provide a damper control apparatus which operates in combination with an axle assembly which is borne by the fume hood; and wherein a cable assembly is borne by the sash and disposed in force transmitting relation relative to the axle assembly.

Another object of the present invention is to provide a damper control apparatus which further includes a clutch which is borne by the fume hood, and which is disposed in force receiving relation relative to the axle assembly, and wherein the clutch is further disposed in force transmitting relation relative to the damper; and wherein means are borne by the fume hood for disengaging the clutch.

Another object of the present invention is to provide a damper control apparatus wherein the damper is moveable along a path of travel from a first, closed position, to a second, open position, and wherein a biasing assembly is borne by the damper and operable to urge the damper toward the second position.

Another object of the present invention is to provide a damper control apparatus which includes an electrical clutch which is engaged when deenergized, and disengaged when energized, and wherein the disengaging means includes an electrical switch which energizes the electrical clutch, and wherein the clutch, when energized, permits the damper to move along the path of travel from the first, closed position, to the second open position.

Another object of the present invention is to provide a damper control apparatus which includes a first gear borne by the axle assembly and which is rotatable therewith; a rotatable shaft borne by the fume hood and which is disposed in space relation relative to the axle assembly, the shaft having proximal and distal ends; a second gear mounted on the proximal end of the shaft and disposed in meshing relation relative to the first gear; a third gear mounted on the distal end of the shaft and disposed in force transmitting relation relative to the clutch; a fourth gear mounted on the clutch and disposed in meshing relation relative to the third gear; a first sprocket mounted on the clutch and disposed in force transmitting relation relative to the damper; a second sprocket mounted on the damper and disposed in force receiving relation relative to the first sprocket; and a chain connecting the first and second sprockets together.

Another object of the present invention is to provide a damper control apparatus which is operable to obtain the individual benefits to be derived from the related prior art devices while avoiding the detriments individually associated therewith.

Another object of the present invention is to provide a damper control apparatus which is characterized by ease of utilization, simplicity of construction, and which further can be sold at a relatively moderate price.

These and other objects and advantages are achieved in a damper control apparatus for a fume hood which has a moveable sash, the damper control apparatus including an axle assembly borne by the fume hood; a cable assembly borne by the sash and disposed in force transmitting relation relative to the axle assembly; and a damper borne by the fume hood and disposed in force receiving relation relative to the axle assembly, the damper moveable along a path of travel into assorted operational positions which correlate with the position of the sash thereby regulating the amount of air withdrawn from the fume hood.

DESCRIPTION OF THE PREFERRED EMBODIMENT

Figure 1:
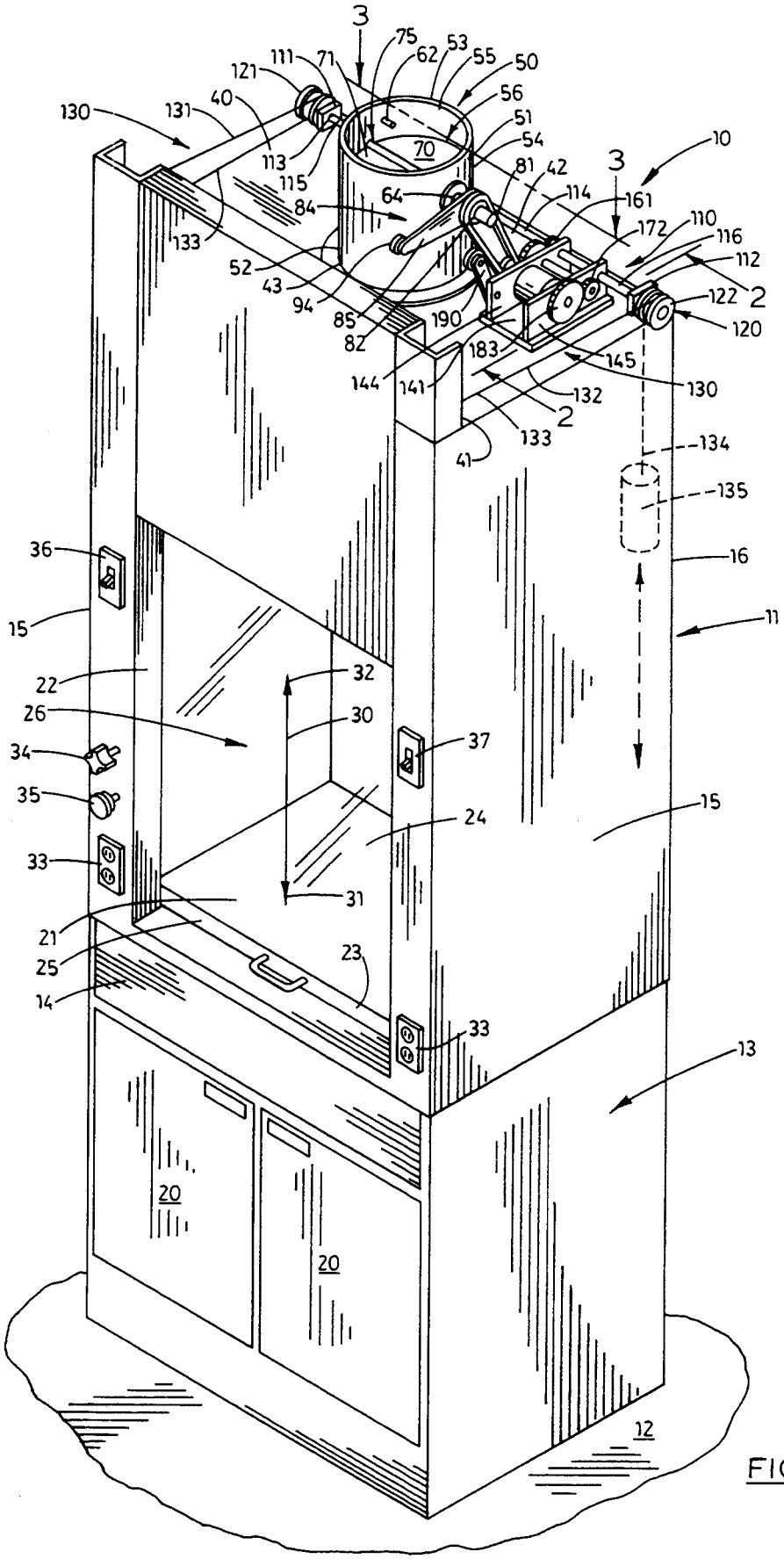
FIG. 1 is a perspective, side elevation view of the damper control apparatus of the present invention showing the invention installed on a fume hood of conventional design.

Referring more particularly to the drawings, the damper control apparatus of the subject invention is generally indicated by numeral 10 in FIG. 1. For illustrative convenience, the apparatus 10 is shown and described herein as it would be utilized in connection with the fume hood 11. However, it should be readily recognized that the subject invention could be employed in combination with any apparatus where the control of air flow should be correlated with the position of another object of interest. The construction of the fume hood will be discussed in greater detail in the paragraphs which follow.

As best seen by reference to FIG. 1, the apparatus 10 of the subject invention is made integral with a fume hood which is generally indicated by the numeral 11. In this regard, it should be understood that the fume hood rests upon the surface of the earth or other supporting surface, such as a laboratory floor 12. The fume hood includes a fume hood base 13 which positions the fume hood in spaced relation relative to the floor 12. The fume hood includes a front or forward facing surface 14; opposite side walls 15; and a rear wall which is generally indicated by the numeral 16. A pair of doors 20 are mounted on the fume hood base 13 and provide a convenient storage space for laboratory supplies, instruments, glassware and the like. The base of the fume hood 13 includes an upwardly facing working surface 21 which is usually manufactured from a substantially chemically inert and fire resistant material. An aperture 22 is defined by the forwardly facing surface. A fume hood sash 23 is movably mounted in a pair of tracks or channels (not shown) which are formed in the forwardly facing surface 14. The fume hood sash includes a glass or other polymeric-based transparent panel 24 which is mounted within a frame 25. The fume hood sash, working surface 21, and side walls 15 define a cavity 26 within which experiments and other research activities take place. As best imagined by a study of FIG. 1, the fume hood sash 23 is movable along a path of travel 30 from the first, closed position 31 wherein the sash substantially occludes the aperture 22 to a second, open position 32 wherein the sash is disposed in partially occluding relation relative to aperture 22 thereby providing access for a laboratory technician to the fume hood cavity 26. As shown in FIG. 1, the front or forwardly facing surface 14, has fixed thereon several electrical outlets 33 which provide a convenient source of electricity and the like, and valves 34 and 35, respectively, which control the supply of flammable gas and water to the fume hood cavity 26. In addition to the foregoing, first and second electrical switches 36 and 37 are mounted on the front or forwardly facing surface 14, and provide a means for energizing the fume hood, and disengaging the clutch assembly. The operation of the individual electric switches as well as a detailed disclosure of the clutch assembly will be discussed in greater detail hereinafter. The fume hood 11 further includes a roof or ceiling panel 40 which is made integral with the side walls 15, and the front and rear walls 14 and 16, respectively. The roof has a first or forward edge 41, and a second or rearward edge 42, which is disposed in substantially parallel spaced relation relative thereto. An aperture 43 is formed substantially centrally of the roof or ceiling panel and thereby connects the fume hood cavity 26 in fluid flowing relation relative to a blower assembly, not shown, and which is operable to withdraw air or other fumes from the cavity and exhaust these sand fumes to the exterior environment.

Mounted in substantial registry, and in fluid flowing relation relative to the aperture 43, is an exhaust pipe or conduit which is generally indicated by the numeral 50. The exhaust pipe or conduit 50 provides a means for channeling or directing air, fumes or other vapors from the cavity 26 to the exterior environment. As noted above, the means utilized for exhausting these fumes, vapors or other gaseous substances is by a blower assembly which is well understood in the art, and which is not shown. The exhaust pipe or conduit has a main body 51 which is substantially cylindrical in shape and which has a first end 52, which is fastened in substantially fluid sealing relation about the aperture 43; and a second end 53 which is remote thereto. The main body 51 further has an exterior facing surface 54, and an opposite interior facing surface 55 which defines an airway or passageway 56 having predetermined dimensions. As best seen by reference to FIGS. 1 and 3, the exhaust pipe or conduit 55 and more specifically, the main body 51 thereof has a pair of substantially coaxially aligned apertures 60 formed therein. Further, and as best seen by reference to FIGS. 2 and 3, first and second damper stops 61 and 62 are fixed at predetermined locations on the interior facing surface of the exhaust pipe 50 thereby providing a convenient means for defining the path of travel of the damper which will be discussed in greater detail hereinafter. The damper stops of the present invention include short posts which are attached on the interior facing surface by welding, or other suitable fastening methods. Fixed on the exterior surface 54 of the main body 51 are first and second bearing assemblies 63 and 64, respectively, and which are of conventional design. The first and second bearing assemblies are operable to rotatably support a damper 70 in various assorted operational positions in the airway or passageway 56 thereby regulating the amount of air, vapor, or other materials being exhausted from the fume hood cavity 26.

The damper, which is generally indicated by the numeral 70, includes a substantially circular and generally planar shaped main body 71 which has an upper facing surface 72, and an opposite, lower facing surface 73. The main body is defined by a peripheral edge 74, and further has a diametral dimension which is less than the diametral dimension of the airway or passageway 56. As best seen by reference to FIG. 3, a drive shaft 75 is made integral with the main body 71 of the damper 70 and is operable to be rotatably received in the first and second bearing assemblies 63 and 64, thereby rendering the damper rotatable in the airway or passageway 56. The drive shaft 75 has opposite first and second ends 80 and 81, respectively. As most clearly seen by reference to FIGS. 2 and 3, a 25-tooth, 25-pitch chain sprocket is fixed on the second end 81 of the drive shaft 75 and is operable to engage a drive chain which will be discussed in greater detail hereinafter. Further, mounted in a predetermined position on the second end 81 of the drive shaft is a weighted drive arm 84. The weighted drive arm has an elongated, main body 85 which extends generally radially outwardly relative to the drive shaft 75 and which has a first end 90, and an opposite second end 91. As best seen in FIG. 3, an aperture 92 is formed in the first end 90 and is operable to receive the drive shaft therethrough. The first end is thereafter secured using suitable fastening methods in a predetermined fixed position relative to the drive shaft 75. A second aperture 93 is formed in the distal, second end 91. A weight of a predetermined magnitude 94 is fixed on the second end 91 by means of a fastener 95 which is threadably received through the aperture 93 and which further threadably engages the weight 94. The operation of the weighted drive arm will be discussed in greater detail hereinafter.

The damper 70 is operable to move along a path of travel 100 from a first, closed or occluding position 101 relative to the passageway 56, to a second, open or nonoccluding position 102 relative to the passageway 56. As will be recognized by a study of FIG. 2, the first position 101 is defined by the first damper stop 61, and the second, nonoccluding position is defined by the second damper stop 62. As will be understood, other means may be employed for defining the path of travel 100 including means mounted exterior to the passageway 56 including a pin, and slotted channel arrangement (not shown). In this arrangement, a slotted channel is fixed on the drive shaft and mounted exterior to the passageway, and a pin is mounted on the exterior surface 54 of the passageway and is received in the channel. In this arrangement, the pin limits the movement of the shaft about its longitudinal axis. Additionally, it should be understood that in view of the wide variety of operational characteristics of blower assemblies which may be utilized with the fume hood 11, the weight 94 which is provided on the weighted drive arm 84 may be increased or decreased to provide various performance characteristics for fume hoods having these diverse blower assembly arrangements. The operation of the damper assembly will be discussed in greater detail hereinafter.

As best seen by FIGS. 1 and 3, the apparatus 10 of the subject invention includes an axle assembly which is generally indicated by the numeral 110, and which is mounted for rotational movement adjacent to the second or rearward edge 42 or ceiling panel 40 of the roof of the fume hood 11. The axle assembly 110 includes first and second frame members 111 and 112 which are fixed on the roof 40, of the fume hood 11, and which extend normally upwardly relative thereto. The first and second frame members each have an aperture 113 formed therein and which has a predetermined diametral dimension, and which is operable to rotatably accommodate or receive an axle 114 which has a predetermined length dimension. The axle is substantially circular in cross section, and the apertures 113 have a diametral dimension which is slightly greater than the outside diametral dimension of the axle 114. The axle has opposite ends 115 and 116, respectively. Fixed on the first and second ends 115 and 116 are pulleys 120 which are of substantially identical dimensions. The pulleys 120 include a first pulley 121, and an opposite, second pulley 122. As should be understood, rotational movement of the pulleys imparts a corresponding rotational movement to the axle assembly.

A cable assembly, which is generally indicated by the numeral 130, is borne by the fume hood sash 23. As best seen by reference to FIGS. 1 and 3, the cable assembly is disposed in force transmitting relation relative to the axle assembly by means of first and second cables 131 and 132, respectively. Each of the cables have a first end 133, which is fixed on the sash, and an opposite, second end 134, which has a weight 132 of a predetermined magnitude attached thereto. The first and second cables are wrapped in a counterclockwise direction (as viewed from FIG. 2) about the individual pulleys 120. When wrapped in this counterclockwise direction, movement of the sash 23, along the path of travel 30 from the first, closed position 31, to the second, open position 32 causes the individual cables to impart a counterclockwise rotational movement to the axle assembly 110 as that is viewed from FIG. 2. Conversely, and when the sash is moved from the second, open position 32, to the first, closed position 31, the cable assembly is operable to rotate the axle assembly in an opposite, clockwise direction as that is viewed from FIG. 2. As will be recognized, the weight 135 is selected to provide a means whereby the sash may be positioned at intermediate locations between the first and second positions 31 and 32, respectively, thereby varying the opening or aperture 22 which provides access to the fume hood cavity 26. Additionally, the wrapping of the individual cables in a counterclockwise direction about the respective pulley assemblies provides an effective means for insuring that the sash 23 moves in a substantially even fashion upwardly, and downwardly. This further substantially inhibits any jamming or cocking of the sash in the fume hood, thus impeding movement of the sash along the path of travel 30.

Figure 2:
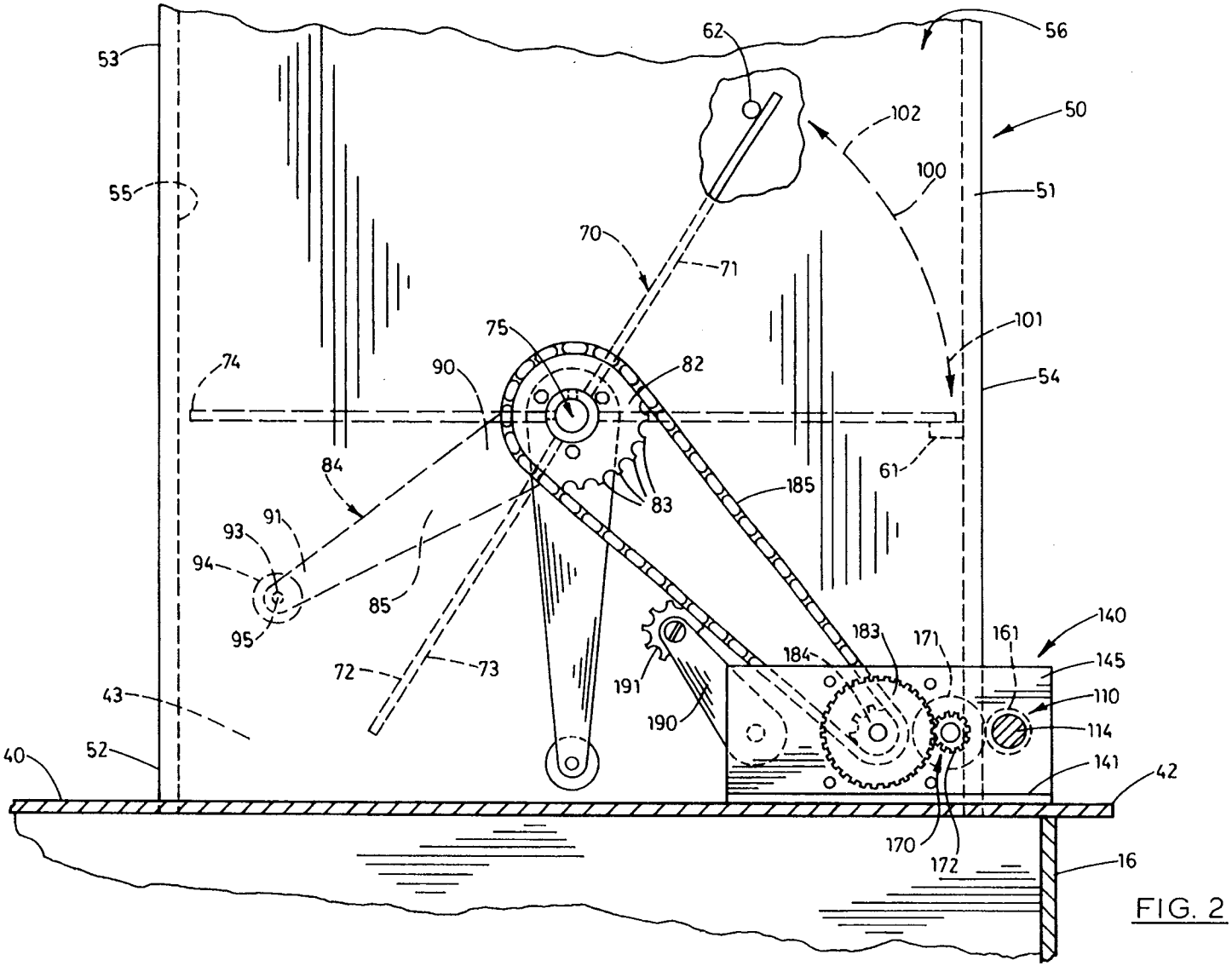
FIG. 2 is a somewhat enlarged, fragmentary, side elevation view of the apparatus of the subject invention and which is taken from a position along line 2—2 of FIG. 1, and which shows some underlying surfaces in phantom line.
Figure 3:
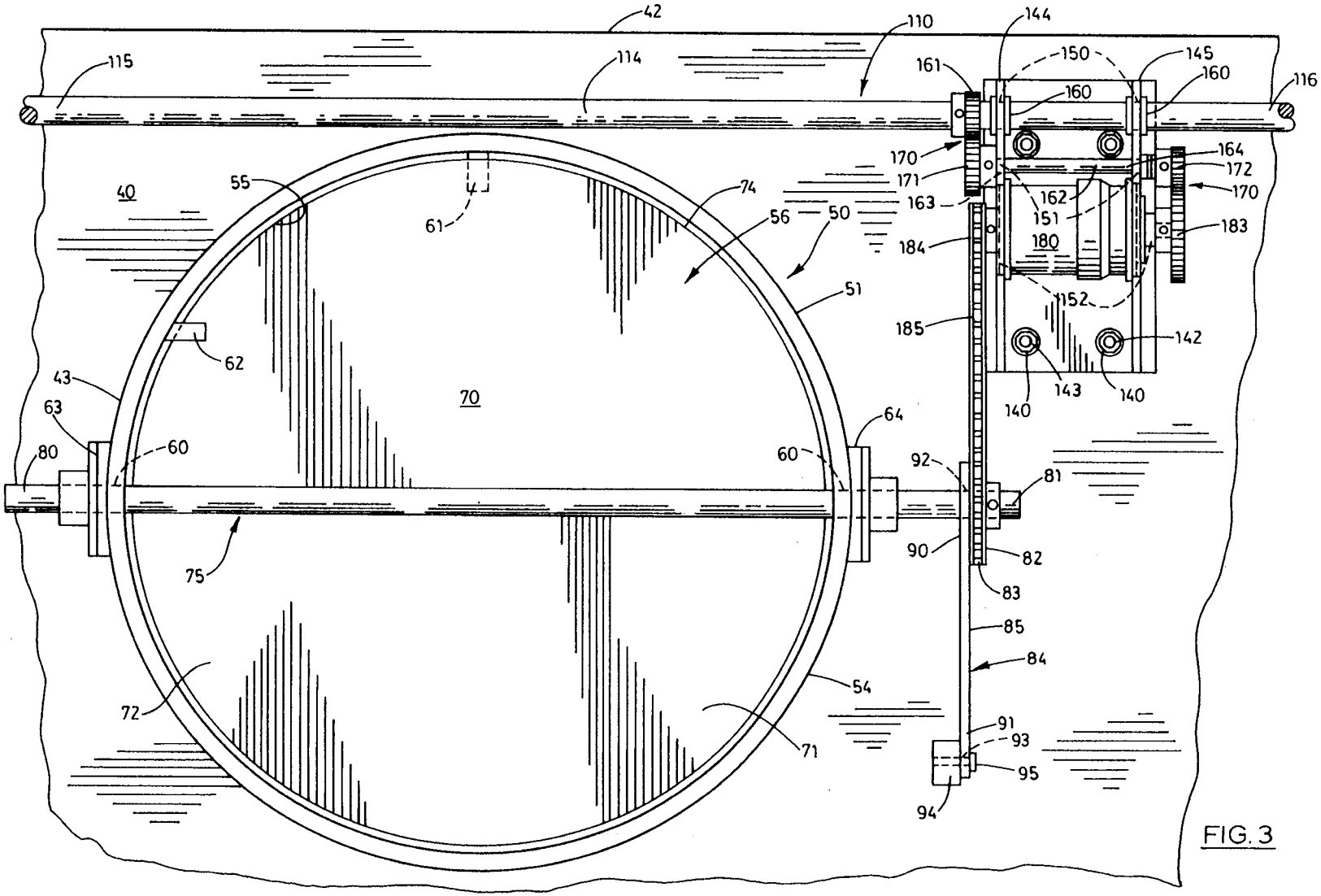
FIG. 3 is an enlarged, fragmentary, plan view of the apparatus of the subject invention and which is taken from a position along line 3—3 of FIG. 1.

As best seen by reference to FIGS. 1 and 2, the damper control apparatus 10 of the present invention includes a support frame 140 which is mounted on the roof 40 of the fume hood 11. The support frame 140 has a base 141 which has a plurality of apertures 142 formed therein. Fasteners 143 are received through the apertures 142 thereby securing the base 141 on the roof 40 of the fume hood 11. As best seen by a study of FIG. 1, left and right sidewalls 144 and 145, respectively, are made integral with the base and extend generally normally, upwardly relative thereto. As best appreciated by a study of FIG. 3, a first pair of substantially coaxial aligned apertures 150 are formed in predetermined positions in the left and right sidewalls 144 and 145, respectively. Further, second and third pairs of coaxial aligned apertures 151 and 152, respectively, are also formed in the left and right sidewalls. As best illustrated by reference to FIG. 3, a pair of bushings or bearings 160 are individually received or secured in registry with each of the first pair of apertures 150. As should be understood, the bushings and/or bearings are operable to rotatably receive or otherwise support the axle 114 therein. A first spur gear 161 is fixed at a predetermined position along the length of the axle 114. The first spur gear is a 16-tooth, 24-pitch spur gear of substantially conventional design. An axle or shaft 162 is rotatably mounted in the second pair of coaxial aligned apertures 151. The axle has a first end 163, and opposite, second end 164. As best seen in FIG. 3, a pair of spur gears 171 are mounted on the first and second ends 163 and 164, respectively. More specifically, a second spur gear 171 is mounted on the first end 163. The second spur gear is a 24-tooth, 24-pitch spur gear. Further, a third spur gear 172 is mounted on the second end 174 thereof. This third spur gear is a 12-tooth, 24-pitch spur gear.

As best seen by reference to FIGS. 1 and 2, an electric clutch 180 is received or otherwise mounted in registry with the third pair of coaxial aligned apertures and is thereby supported or otherwise fixed in a predetermined position between the left and right sidewalls 144 and 145. The electric clutch is of conventional design and is commercially available from a number of manufactures. The electric clutch operates in a fashion whereby it is normally engaged when deenergized, and disengages when it becomes energized. As should be understood the clutch 180 is electrically connected with the second electrical switch 37. Therefore, in operation, should an operator wish to disengage the clutch, he or she would merely actuate the switch 37 thereby energizing the clutch and causing it to become disengaged. Conversely, deactivating the electrical switch causes the clutch to become engaged. The significance of this feature will be discussed in greater detail hereinafter. The clutch has an input shaft 181 and an opposite output shaft 182. As best seen in FIG. 3, a fourth spur gear is fixed on the input shaft 181. The fourth spur gear is a 40-tooth, 24-pitch spur gear. A chain sprocket 184 is mounted on or otherwise fixed on output shaft 182. The chain sprocket includes a 10tooth, 25-pitch chain sprocket. As best illustrated by FIG. 1, a chain 185 connects the chain sprocket 184 with the chain sprocket 82. The apparatus 10 further includes a support member 190 which mounts an idler sprocket 191. The idler sprocket engages and thereby maintains the tension of the chain 185 about chain sprockets 184 and 82, respectively.

As best seen by reference to FIG. 3, the clutch 180 is disposed in force receiving relation relative to the axle assembly 110 and is further disposed in force transmitting relation relative to the damper 70. Further and as noted earlier, means are borne by the fume hood 11 for disengaging the clutch 180. In this regard, a second electrical switch 37 is provided and which energizes the clutch thereby causing it to become disengaged. As should be recognized, movement of the sash 23 from a first, closed position 31 along the path of travel 30 towards the second position 32 causes the cable assembly 130 to impart counterclockwise rotational movement to the axle assembly 110 as that is viewed from FIG. 2. As will be recognized, the first spur gear 161 is disposed in meshing, force transmitting relation relative to the second spur gear 171. Therefore, counterclockwise rotational movement of the first spur gear imparts clockwise rotational movement to the second spur gear 171. This clockwise rotational movement of the second spur gear is transmitted through the axle 162 to the third spur gear thereby causing it simultaneously to rotate in a clockwise direction as that is viewed from FIG. 2. As best seen in FIG. 3, the third spur gear 172 is disposed in meshing, force transmitting relation relative to the fourth spur gear 183 which is fixed on the input shaft 181 of the clutch 180. As will be recognized, clockwise rotational movement of the third spur gear causes a corresponding counterclockwise rotational movement of the fourth spur gear 183. This counterclockwise motion of the fourth spur gear is transmitted through the clutch, when it is in an engaged deenergized state, to the chain sprocket 184 which is fixed on the output shaft 182. The counterclockwise motion of the chain sprocket 184 is thereafter transmitted through the chain 185 to the chain sprocket 82 which is fixed on the second end 81 of the drive shaft 75. When this event occurs, the main body 71 of the damper assembly 70 moves along the path of travel 100 from a first, closed, or occluding position 101, to a second, open or nonoccluding position 102. As will be recognized, as the damper moves towards the open, nonoccluding position, increasing volumes of air, fumes or vapors may be removed from the fume hood cavity 26. Conversely, and as the fume hood sash 23 is moved towards the first, or closed position 31, the damper control apparatus 10 moves the main body 71 of the damper 70 from the second, open or nonoccluding position towards the first, closed or occluding position 101. In this fashion, the damper control apparatus is operable to maintain an air flow rate which is appropriate for the position of the sash 23, that is, a nearly closed sash requires a lower flow rate than an open sash. As will be recognized, the damper control apparatus of the present invention substantially correlates the position of the damper 70 with the position of the sash 23 thereby providing an effective means for positioning the damper in an appropriate location to permit an effective amount of air, gas, or other vapors to be withdrawn from the fume hood 1 thereby providing a safe laboratory environment.

The apparatus 10 of the subject invention further provides a means whereby the clutch 180 may be disengaged thereby allowing the main body 71 of the damper 70 to move, under the influence of the weighted drive arm 84, along the path of travel 100 from the first, closed position 101 to the second, open position 102 thereby providing maximum air or fume withdrawal from the fume hood cavity 26. As should be understood, in some laboratory environments, accidents such as explosions, fires or other events may occur in the fume hood cavity and which require that the maximum amount of air or fume withdrawn be accomplished as soon as possible. In this regard, this maximum withdrawal of fumes may need to occur when the fume hood sash 23 is in, or near the first, closed position 31. In order to achieve this end, the apparatus 10 is provided with a second electrical switch 37 which is mounted on the fume hood 11 and which may be actuated by the operator. As earlier discussed, this switch causes the clutch to be energized. As noted above, when the clutch becomes energized, the clutch disengages thereby allowing the weighted arm 84 to drive the damper 70 along the path of travel 100 from the first, closed or occluding position 101, to the second, open or nonoccluding position 102. This is best illustrated by a study of FIG. 2. When this event occurs, maximum air withdrawal may take place from the cavity 26 of the fume hood notwithstanding the position of the sash 223.

OPERATION

The operation of the described embodiment of the present invention is believed to be readily apparent and is briefly summarized at this point.

The damper control apparatus 10 of the present invention finds utility when used in combination with a fume hood 11. As best seen in FIG. 1, the damper control apparatus includes an axle assembly which is generally indicated by the numeral 110 and which is borne by the fume hood; a cable assembly 130 is borne by the fume hood sash 23 and is disposed in force transmitting relation relative to the axle assembly; and a damper 70 is borne by the fume hood and disposed in force receiving relation relative to the axle assembly. The damper is moveable along a path of travel 100 into assorted operational positions which correlate with the position of the sash 23 thereby regulating the amount of air withdrawn from the cavity 26 of the fume hood 11. More specifically, the apparatus 10 includes a clutch 180 which is borne by the fume hood, and which is disposed in force receiving relation relative to the axle assembly, and which further is disposed in force transmitting relation relative to the damper. The apparatus 10 also includes a means borne by the fume hood for disengaging the clutch. As discussed earlier, a second electrical switch 37 is connected in signal transmitting relation relative to the clutch and is operable to energize the clutch thereby causing the clutch to disengage from the output shaft 182. Upon energizing the clutch, the weighted drive arm 84 is operable to move the damper 70 along the path of travel 100 from the first, closed or occluding position 101 to the second, open or nonoccluding position 102. As earlier discussed, the second switch provides a means whereby maximum air flow can be provided for the cavity 26 of the fume hood 11 regardless of the position of the sash 23 for emergency situations, as where a mishap in the fume hood requires maximum evacuation of vapors thereby preventing a safety hazard from developing in the immediate laboratory environment.

In normal operation, the clutch 180 is in an engaged, deenergized state thereby causing the damper 70 to move in a coordinated, correlated fashion with the sash 23. As earlier discussed, as the sash moves along the path of travel 30 from the first, closed position to the second, open position 32, the damper 70 moves along its respective path of travel 100 from the first, closed or occluding position 101 to the second, open or nonoccluding position 102. As will be recognized, the first, closed or occluding position causes a minimal amount of air to be withdrawn from the fume hood cavity, and the second, open or nonoccluding position permits the maximum amount of air to be withdrawn from the fume hood cavity 26.

In operation, and as the sash 23 is moved along its respective path of travel 30 from the first or closed position 31 to the second or open position 32, the axle assembly 110 imparts rotational movement to the first spur gear 161. A support frame 140 is borne by the fume hood 11 and includes a rotatable axle or shaft 162 which is disposed in space relation relative to the axle assembly 110. The shaft 162 has a proximal, or first end 163, and an opposite, or distal second end 164. A second spur gear 171 is mounted on the proximal end of the shaft and disposed in meshing relation relative to the first spur gear. A third spur gear 172 is mounted on the distal end of the shaft and disposed in force transmitting relation relative to the input shaft 181 of the clutch 180. A fourth spur gear 183 is mounted on the input shaft of the clutch and disposed in meshing relation relative to the third spur gear. A first sprocket 184 is mounted on the output shaft 182 of the clutch 180 and disposed in force transmitting relation relative to the drive shaft 75 of the damper 70. A second sprocket 82 is mounted on the drive shaft of the damper and disposed in force receiving relation relative to the first sprocket. A chain 185 connects the first and second sprockets in force transmitting relation together.

Therefore, the apparatus 10 of the subject invention can be employed in a wide variety of operative environments and can be manufactured and purchased at a moderate cost when compared to related prior art devices. The present apparatus is highly efficient in operation, and is compact, thereby facilitating its utilization and maintenance, and is further designed in a fashion whereby it reduces, to an absolute minimum, the assorted problems associated with many of the prior art devices which are designed for substantially identical purposes.

Although the present invention has been herein shown and described in what is conceived to be the most practical and preferred embodiment, it is recognized that departures may be made therefrom within the scope of the invention which is not to be limited to the illustrated details disclosed.

Having described my invention, what I claim is new and desire, to secure by Letters Patent of the United States is:

1. A damper control apparatus for a fume hood which has a moveable sash, the damper control comprising:

an axle assembly borne by the fume hood;

a cable assembly borne by the sash and disposed in force transmitting relations relative to the axle assembly, and wherein the cable assembly includes a cable which has opposite ends, and wherein one end of the cable is fixed on the sash, and the opposite end of the cable has a weight fixed thereon, and wherein the cable is wrapped about the axle assembly in a predetermined direction, and wherein movement of the sash causes rotational movement of the axle assembly;

a damper borne by the fume hood and disposed in force receiving relation relative to the axle assembly;

a clutch borne by the fume hood and which is disposed in both force receiving relation relative to the axle assembly, and in force transmitting relation relative to the damper; and means borne by the fume hood for disengaging the clutch and wherein the damper is moveable along a path of travel into assorted operational positions which correlate with the position of the sash, thereby regulating the amount of air withdrawn from the fume hood.

2. An apparatus as claimed in claim 1, and wherein the clutch has input and output shafts, and wherein the damper has a drive shaft, and wherein the output shaft of the clutch is disposed in force transmitting relation relative to the drive shaft of the damper, and the input shaft is disposed in force receiving relation relative to the axle assembly; and wherein the damper is moveable along the path of travel from a first, closed position, to a second, open position, and wherein a biasing assembly is borne by the damper and operable to urge the damper into the second position.

3. An apparatus as claimed in claim 2, and wherein the apparatus further includes:

a first gear borne by the axle assembly and which is rotatable therewith;

a rotatable shaft borne by the fume hood and which is disposed in spaced relation relative to the axle assembly, the shaft having proximal and distal ends;

a second gear mounted on the proximal end of the shaft and disposed in meshing relation relative to the first gear;

a third gear mounted on the distal end of the shaft and disposed in force transmitting relation relative to the input shaft of the clutch;

a fourth gear mounted on the input shaft of the clutch and disposed in meshing relation relative to the third gear;

a first sprocket mounted on the output shaft of the clutch and disposed in force transmitting relation relative to the drive shaft of the damper;

a second sprocket mounted on the drive shaft of the damper and disposed in force receiving relation relative to the first sprocket; and a chain connecting the first and second sprockets together.

4. An apparatus as claimed in claim 3, and wherein the clutch is an electrical clutch which is engaged when deenergized and disengaged, when energized; and wherein the disengaging means includes an electrical switch which energizes the electrical clutch; and wherein the clutch, when energized, permits the damper to move along the path of travel from the first, closed position to the second, open position.

5. An apparatus as claimed in claim 4, and wherein the damper includes a movement limiting member which defines the path of movement of the damper, and an idler sprocket is borne by the fume hood and is operable to engage the chain.

6. An apparatus as claimed in claim 5, and wherein the first gear is 16-tooth, 24-pitch spur gear; the second gear is a 24-tooth, 24-pitch spur gear; the third gear is a 12-tooth, 24-pitch spur gear; the fourth gear is a 40-tooth, 24-pitch spur gear; the first sprocket is a 10-tooth, 25-pitch sprocket, and the second sprocket is a 25-tooth, 25-pitch sprocket.

7. A damper control apparatus for a fume hood which has a moveable sash, the damper control apparatus comprising:

an axle assembly borne by the fume hood;

a cable assembly borne by the sash and disposed in force transmitting relation relative to the axle assembly, and wherein movement of the sash imparts rotational movement to the axle assembly;

a clutch borne by the fume hood and having an input shaft, and an output shaft, and wherein the input shaft is disposed in force receiving relation relative to the axle assembly;

a damper borne by the fume hood and moveable along a path of travel into assorted operational positions which correlate with the position of the sash thereby regulating the amount of air withdrawn from the fume hood, and wherein the damper is disposed in force receiving relation relative to the output shaft of the clutch; and a means for disengaging the clutch thereby releasing the damper from the influence of the damper control apparatus.

8. An apparatus as claimed in claim 7, and wherein the cable assembly includes a cable which has opposite ends, and wherein one end of the cable is fixed on the sash, and wherein the opposite end of the cable has a weight fixed thereon, and wherein the cable is wrapped about the axle assembly in a predetermined direction, and wherein movement of the sash causes rotational movement of the axle assembly.

9. An apparatus as claimed in claim 8, and wherein the damper is moveable along the path of travel from a first, closed position wherein the amount of air withdrawn from the fume hood is at a predetermined minimum to a second, open position wherein the amount of air withdrawn from the fume hood is at a predetermined maximum.

10. An apparatus as claimed in claim 9, and wherein the apparatus further includes:

a first gear borne by the axle assembly and which is rotatable therewith;

a rotatable shaft borne by the fume hood and which is disposed in spaced relation relative to the axle assembly, the shaft having proximal and distal ends;

a second gear mounted on the proximal end of the shaft and disposed in meshing relation relative to the first gear;

a third gear mounted on the distal end of the shaft and disposed in force transmitting relation relative to the input shaft of the clutch;

a fourth gear mounted on the input shaft of the clutch and disposed in meshing relation relative to the third gear;

a first sprocket mounted on the output shaft of the clutch and disposed in force transmitting relation relative to the drive shaft of the damper;

a second sprocket mounted on the drive shaft of the damper and disposed in force receiving relation relative to the first sprocket; and a chain connecting the first and second sprockets together.

11. An apparatus as claimed in claim 10, and wherein the clutch is an electrical clutch which is engaged when deenergized and disengaged when energized, and wherein the means for disengaging the clutch includes an electrical switch which energizes the electrical clutch, and wherein the clutch, when energized, permits the damper to move along the path of travel from the first, closed position to the second, open position.

12. An apparatus as claimed in claim 11, and wherein the damper includes a movement limiting member which defines the path of movement of the damper, and wherein an idler sprocket is borne by the fume hood and is operable to engage the chain.

13. An apparatus as claimed in claim 12 and wherein the first gear is a 16-tooth, 24-pitch spur gear; the second gear is a 24-tooth, 24-pitch spur gear; the third gear is a 12-tooth, 24-pitch spur gear; the fourth gear is a 40-tooth, 24-pitch spur gear; the first sprocket is a 10-tooth, 25-pitch sprocket; and the second sprocket is a 25-tooth, 25-pitch sprocket.

14. A damper control apparatus for a fume hood having a sash which is moveable from a closed position, to an open position, the damper control apparatus comprising:

an axle assembly borne by the fume hood;

a cable assembly borne by the sash and disposed in force transmitting relation relative to the axle assembly, and wherein movement of the sash imparts rotational movement to the axle assembly;

a first gear borne on the axle assembly and which is rotatable therewith;

a rotatable shaft borne on the fume hood and which is disposed in spaced relation relative to the axle assembly, the shaft having opposite proximal and distal ends;

a second gear mounted on the proximal end of the shaft and disposed in meshing relation with the first gear;

a third gear mounted on the distal end of the shaft;

a clutch borne by the fume hood and having input and output shafts;

a fourth gear mounted on the input shaft of the clutch and disposed in meshing relation relative to the third gear;

a first sprocket mounted on the output shaft of the clutch;

a damper borne by the fume hood and moveable along a path of travel from a first, closed position, to a second, open position, and wherein the damper position correlates with the position of the sash thereby regulating the amount of air withdrawn from the fume hood, and wherein the damper further includes a drive shaft;

a second sprocket mounted on the drive shaft of the damper; and a drive chain disposed in driving relation about the first and second sprockets, and wherein the movement of the sash from the closed position to the open position causes the damper to move from the first, closed position to the second, open position.

15. An apparatus as claimed in claim 14, and wherein the apparatus further includes a means borne by the fume hood for disengaging the clutch, and a biasing assembly is borne by the damper and operable to urge the damper along the path of travel and toward the second, open position when the clutch is disengaged.

16. An apparatus as claimed in claim 15, and wherein the clutch is an electrical clutch which is engaged when deenergized, and disengaged when energized, and wherein the disengaging means includes an electrical switch which energizes the electrical clutch, and wherein the clutch, when energized, permits the damper to move along the path of travel from the first, closed position to the second, open position under the influence of the biasing assembly.

17. An apparatus as claimed in claim 15, and wherein the first gear is a 16-tooth, 24-pitch spur gear; the second gear is a 24-tooth, 24-pitch spur gear; the third gear is a 12-tooth, 24-pitch spur gear; the fourth gear is a 40-tooth, 24-pitch spur gear; the first sprocket is a 10-tooth, 25-pitch sprocket; and the second sprocket is a 25-tooth, 25-pitch sprocket.

* * * * *